US010980355B2

(12) United States Patent
Degon et al.

(10) Patent No.: US 10,980,355 B2
(45) Date of Patent: Apr. 20, 2021

(54) MOBILE DIAPER CHANGING STATION

(71) Applicants: Eric Wayne Degon, Lawrenceville, GA (US); Lena Nafez Zohbe, Lawrenceville, GA (US)

(72) Inventors: Eric Wayne Degon, Lawrenceville, GA (US); Lena Nafez Zohbe, Lawrenceville, GA (US)

(73) Assignee: Eric Degow, Lawrenceville, GA (US)

( * ) Notice: Subject to any disclaimer, the term of this patent is extended or adjusted under 35 U.S.C. 154(b) by 585 days.

(21) Appl. No.: 15/137,163

(22) Filed: Apr. 25, 2016

(65) Prior Publication Data

US 2017/0303701 A1 Oct. 26, 2017

(51) Int. Cl.
*A47D 5/00* (2006.01)
*A47D 7/00* (2006.01)

(52) U.S. Cl.
CPC ..... *A47D 5/006* (2013.01); *A47D 5/003* (2013.01); *A47D 5/00* (2013.01); *A47D 7/002* (2013.01)

(58) Field of Classification Search
CPC . A47D 5/00; A47D 5/006; A47D 7/00; A47D 7/002; A47D 7/005; A47D 7/01; A47D 7/02; A47D 7/04; A47D 9/00; A47D 9/005; A47D 13/06; A47D 13/061; A47D 13/065; A47D 13/066
USPC ..... 5/655, 93.1, 94, 99.1, 118, 947
See application file for complete search history.

(56) References Cited

U.S. PATENT DOCUMENTS 1,493,104 A * 5/1924 Carrigan ..... A47C 17/80 5/11
1,653,246 A * 12/1927 Zichy ..... A47D 5/006 190/10
D174,004 S * 2/1955 Schiffman ..... 297/254
2,826,764 A * 3/1958 Brand ..... B60N 2/2854 5/175
2,869,144 A * 1/1959 Schiffman ..... B60N 2/2854 292/202
RE25,063 E * 10/1961 Schiffman ..... B60N 2/2854 5/94
3,436,770 A * 4/1969 Turner ..... A47D 7/002 5/94
3,735,430 A * 5/1973 Platz ..... A47D 7/04 5/118
4,216,951 A 8/1980 Griffin
4,573,608 A * 3/1986 Hansen ..... A47D 5/003 221/92
4,876,970 A * 10/1989 Bolduc ..... A47D 5/003 108/35
4,965,896 A 10/1990 Berger
(Continued)

*Primary Examiner* — Robert G Santos

(57) ABSTRACT

The inventive concept discloses a portable diaper changing stand comprising a horizontally oriented platform, connected by a hinge mechanism to a vertically-oriented frame. The frame and platform, being hingedly connected, may either be deployed opposite each other by optimally, a ninety (90) degree angle, or folded together to form a compacted unit. The vertical frame also contains a recessed compartment for storage of various items. The diaper changing stand is constructed so as to provide for vertical mounting or placement on the surface of a bench, sofa, or similar seating structure. This is accomplished by means of U-brackets secured to the top of the frame and an extendable horizontal support bar that is vertically adjustable.

12 Claims, 5 Drawing Sheets

(56) References Cited

U.S. PATENT DOCUMENTS

| | | | | | |
|---|---|---|---|---|---|
| 5,215,172 | A * | 6/1993 | Stevenson | A45C 9/00 | 190/1 |
| 5,471,689 | A * | 12/1995 | Shaw | A47C 21/08 | 5/426 |
| 5,987,677 | A | 11/1999 | Betker | | |
| 6,134,731 | A * | 10/2000 | Thom | A61G 7/0507 | 5/424 |
| 6,327,726 | B1 * | 12/2001 | Weber | A47D 5/006 | 297/219.1 |
| 6,389,624 | B1 | 5/2002 | Madole | | |
| 6,421,856 | B1 * | 7/2002 | Furnback | A47D 5/00 | 5/118 |
| 6,889,397 | B2 | 5/2005 | Rosenberg | | |
| 7,350,252 | B2 | 4/2008 | Telegadis | | |
| 7,426,765 | B2 | 9/2008 | Helmsderfer | | |
| 7,520,010 | B2 | 4/2009 | Welch | | |
| 7,891,034 | B2 * | 2/2011 | Smith | A47D 5/006 | 5/655 |
| 8,973,757 | B2 * | 3/2015 | Fimbrez | A45C 9/00 | 190/2 |
| 9,301,623 | B2 * | 4/2016 | Herdman | A47D 5/003 | |
| 2010/0138995 | A1 * | 6/2010 | Smith | A47D 5/003 | 5/424 |
| 2014/0374305 | A1 * | 12/2014 | Fimbrez | A45C 9/00 | 206/581 |
| 2015/0282637 | A1 * | 10/2015 | Herdman | A47D 5/00 | 5/655 |
| 2017/0303701 | A1 * | 10/2017 | Degon | A47D 5/003 | |

* cited by examiner

MOBILE DIAPER CHANGING STATION

CROSS-REFERENCES TO RELATED APPLICATIONS

Not Applicable.

STATEMENT REGARDING FEDERALLY SPONSORED RESEARCH OR DEVELOPMENT

Not applicable.

BACKGROUND OF THE INVENTION

(1) Field of the Invention

The present invention generally relates to infant diaper changing tables. More particularly, the inventive concept is concerned with diaper changing stands that are portable and that can be fitted onto or attached to another structure such as a door, an item of furniture, or a wall.

(2) Description of the Related Art, Including Information Disclosed Under 37 CFR 1.97 and 1.98

Infant diaper changing practices and structures have progressed from the use of a bed to changing tables of the kind contrived by mounting a soft pad over a dresser or other stationary furniture for use at home. There are many households where either there are not enough rooms to set up a separate baby nursery or limited space to set up a separate changing station such as the use of a dresser or other furniture to change the infant's diapers.

Mothers (or fathers) commonly use a bed a carpeted floor, or a kitchen countertop, etc., to change an infant's soiled diapers. These practices present an obvious problem with respect to hygiene. There has long been need for a portable, hygienic, and stable structure specifically designed for the process of changing an infant's diaper.

The inventive concept disclosed is dedicated to an infant's diaper changing needs in households with limited space. The device provides a space-saving changing table that can be installed on either side of a room door to meet the diaper changing needs of a baby and conveniently folded up on its base to lie against the door surface and away from traffic between rooms when not in use.

The need for a means to change infant's diapers when away from home has produced several innovative concepts in portable diaper changing structures such as pads and tables described in U.S. Pat. No. 7,520,010, U.S. Pat. No. 7,350,252, and U.S. Pat. No. 6,889,397. There are also portable changing tables of the kind disclosed in U.S. Pat. No. 6,421,856 and U.S. Pat. No. 6,389,624. These pads and tables are quite often bulky and take up space in a vehicle in addition to other baby changing and feeding luggage such as diaper bags and accessories, strollers etc., when traveling with a baby. The present invention provides a space saving changing table that can be stored by family and friends at their residences and easily set up to provide a changing table for a visiting baby.

The frequency with which parents travel with small babies wearing diapers has seen the advent of wall mounted baby changing tables in many restroom facilities. U.S. Pat. No. 4,216,951, one such earlier granted patent discloses a baby-changing apparatus adapted to be foldably mounted to a vertical support, such as walls and partitions in public restrooms, restaurants, department stores, airports, and the like. U.S. Pat. No. 4,965,896 describes a fold up table extending from a room wall and constructed of a hollow rectangular tray capable of supporting a baby while the baby's diaper is being changed. A countertop mountable infant changing station is described in U.S. Pat. No. 5,987,677. A series of patents granted to Helmsderfer, the most recent one described in U.S. Pat. No. 7,426,765 comprises a diaper changing station for mounting on a wall surface.

The infant diaper changing tables described and patented thus far have been configured for wall mounting which involves drilling holes in walls in order to mount these structures. Dismantling and moving these changing tables to another location on the wall or to another room wall would be cumbersome and leave holes in the walls requiring patching up, painting etc. Thus, there is a need in the art for a space saving infant changing table that can be conveniently mounted, with minimal damage to the mounting surface and removed for storage when not in use.

The present invention overcomes the deficiencies in the designs and structure of prior art diaper changing devices. The inventive concept disclosed is a portable and efficient space-saving diaper changing stand for use at home, when visiting the homes of family or friends; in automobiles, day care centers, or in public restrooms.

BRIEF SUMMARY OF THE INVENTION

The inventive concept discloses a mobile diaper changing station comprising a horizontally oriented platform, connected by a horizontally-oriented hinge mechanism to a vertically-oriented frame. The vertical frame also contains a recessed compartment for storage of various items and a pair of inverted U-shaped brackets for facilitating suspension on a vertical structure such as the backrest of a sofa or bench. For compact carriage and mobility, the vertical frame and the platform may be hingedly rotated toward each other and secured as one compacted unit, by means of embedded magnets other types of fasteners.

When deployed for use, the platform provides adequate space and a strapping mechanism for safe retention of the infant's midsection while diaper changing is accomplished. A lengthwise support bar on the bottom surface of the platform provides additional support for the infant's weight, and further, the support bar is vertically adjustable to allow flexibility in rendering the platform a level surface while coping with a slanting or uneven immediate environment.

DETAILED DESCRIPTION OF THE INVENTION

The objects, features, and advantages of the inventive concept presented in this application are more readily understood when referring to the accompanying drawings. The drawings, totaling nine figures, show the basic components and functions of embodiments and/or methods of use. In the several figures, like reference numbers are used in each figure to correspond to the same component as may be depicted in other figures.

Figure 1:
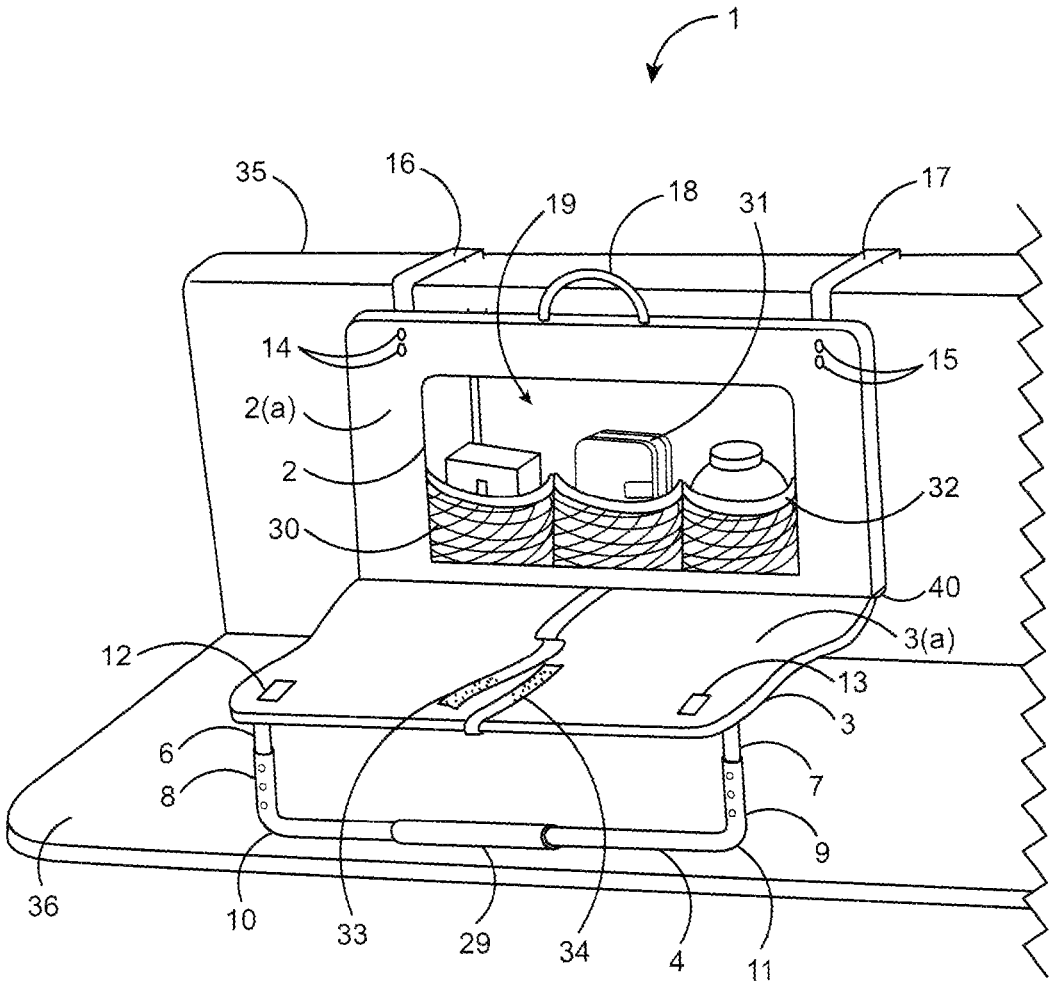
FIG. 1 presents an overall view of the changing station shown fully deployed and supported on the backrest of a sofa, automobile seat, or similarly configured seating apparatus.

The discussion of the present inventive concept will be initiated with FIG. 1, which illustrates an overall view of the changing station 1 shown fully deployed and supported on the backrest 35 of a sofa, bench, or similar seating structure 36. The principal components of the changing station 1 are shown to be its vertically-oriented frame 2 and an extendable changing platform 3. The frame 2, having a front surface 2(*a*) and a rear surface 2(*b*), and the platform 3, having an inner surface 3(*a*) and an undersurface 3(*b*) [not shown] both comprise essentially the same, compatible length and width dimensions. The frame 2 further comprises a recessed compartment 19, a left inverted U-bracket 16 and a right inverted U-bracket 17.

Also shown in FIG. 1 is a spaced-apart, support bar 4 which is attached in a parallel manner to the undersurface 3(*b*) [not shown] of the platform 3. The support bar 4 may be rotatingly deployed through a ninety (90) degree arc into a fixed position orthogonal to the undersurface 3(*b*) of said platform 3.

Again referring to FIG. 1, a padded "wrap-around" 29, which comprises a friction-enhanced material, encircles the mid-section of the support bar 4. The wrap-around 29 serves to aid in preventing slippage or unwanted movement of the support bar 4 along the horizontal surface of a structure on which the diaper changing station 1 may be deployed.

Figure 2:
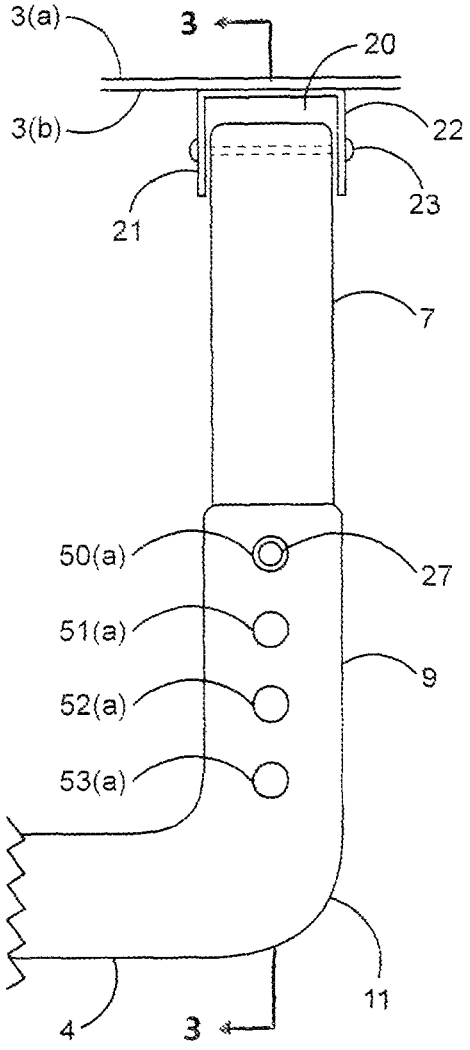
FIG. 2 presents a close-up frontal view of the right inner leg 7 and right outer tube 9 and an anchor support 20.
Figure 3:
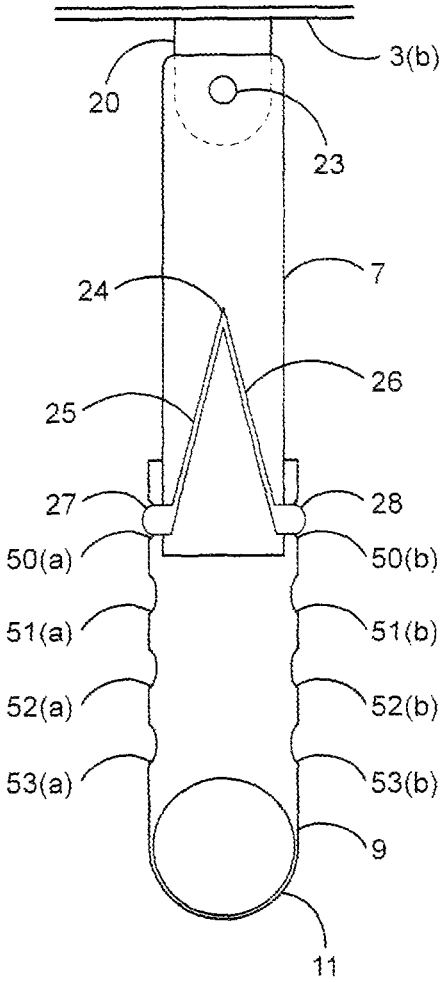
FIG. 3 illustrates the right-side view of the right outer tube 9 and right inner leg 7 as seen from the perspective of section line 3-3 of FIG. 2, further showing a V-spring 24 maintaining the right leg 7 at a desired height.

In FIG. 1, it is seen that the support bar 4 comprises a left elbow 10, which transitions to a left outer tube 8; and a right elbow 11, which transitions to a right outer tube 9. The left outer tube 8 envelopes a left inner leg 6, and similarly, the right outer tube 9 envelopes a right inner leg 7. FIG. 2 and FIG. 3 depict close-up frontal views of the right elbow 11, right outer tube 9, and right inner leg 7. The upper end of the right leg 7 is attached to the undersurface 3(*b*) of the platform 3 by means of a bracket 20, which bracket 20 is more clearly detailed in FIG. 2. The main body of the bracket 20 is permanently affixed to the undersurface 3(*b*) of the platform 3. The bracket 20 comprises a main body 20(*a*), left support 21 and a right support 22, both supports 21, 22 manifesting co-axial apertures 37, 38. Both supports 21, 22, are constructed orthogonally to the main body 20(*a*) of the bracket 20.

Figure 6:
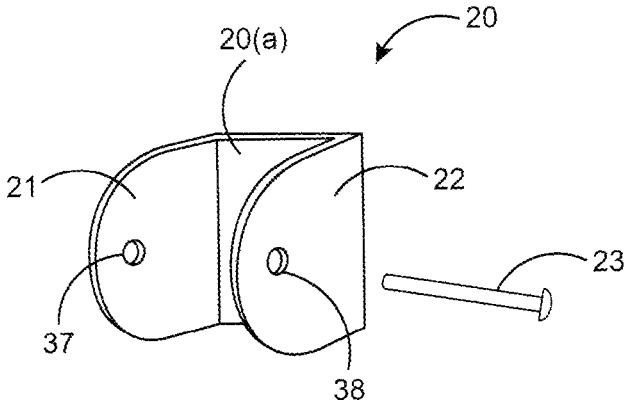
FIG. 6 is a perspective view, typical of both of the device anchor supports 20 and further shows the axle 23 which serves as an axis or rotation for the left and right inner legs 6, 7 of the device.

Both the right inner leg 7 and the left inner leg 6 are connected to the undersurface 3(*b*) of the platform 3. Details of the bracket 20 are illustrated in FIG. 6. As shown in FIG. 6, the left support 21 and right support 22 manifest co-axial apertures, a left, aperture 37 and right aperture 38. Both apertures 37, 38, are of a diameter corresponding to the outer diameter of a hinge pin, or axle 23. In manufacturing of the changing station 1, the axle 23 is placed first through one of the apertures 37, 38, through both inner legs 6, 7, and then through the remaining aperture, 37 or 38. Both ends of the axle 23 are fitted with a larger diameter, rounded head for purposes of retention of the axle 23. This construction of left and right brackets 20 permits both the right inner leg 7 and the left inner leg 6 to rotate about their respective axles 23 and thereby position the support bar 4 of the changing station 1.

Figure 7:
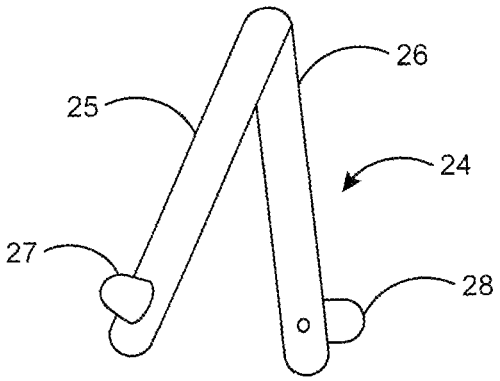
FIG. 7 shows a perspective view of the V-spring 24 utilized within both inner legs 6, 7 of the changing station.

In referring to FIG. 3, there is illustrated a cutaway view of the right inner leg 7, right outer tube 9, and the right elbow 11 of the changing station 1, as is displayed in accordance with section line A-A of FIG. 2. Internal to the right inner leg 7 is a V-spring 24, which comprises a left branch 25 connected to a left pin 27, a right branch 26 connected to a right pin 28. The left pin 27 and right pin 28 normally protrude from a pair of co-axial holes 50(*a*)-50(*b*), 51(*a*)-51(*b*), 52(*a*)-52(*b*), or 53(*a*)-53(*b*) which are constructed in the right outer tube 9. Similarly, a second V-spring (not shown) is constructed interiorly to the left inner leg 6 and its pins protrude outwardly from corresponding co-axial holes drilled through the left outer tube 8. The V-spring 24 used in both outer tubes 8, 9 is shown in more detail in FIG. 7.

With the changing station 1 placed in use in a position as shown in FIG. 1, the user of the diaper changing station 1 may adjust the height or angle of the platform 3 by means of the V-springs 24. This action is described by reference to the device components shown in FIG. 3. The height or angle is changed by applying finger pressure simultaneously to the let pin 27 and right pin 28 such that the tips of both pins 27, 28 become recessed within the particular pair of co-axial holes. When this finger pressure is exerted, the outer tube 9 may then be moved a desired distance (upward or downward, as appropriate) until the tips of the two pins 27, 28 re-emerge in the desired pair of co-axial holes. Finger pressure is then released and the two pins 27, 28 are allowed to protrude through the co-axial holes to fix the inner leg 7 in place within the outer tube 9.

In actuality, the adjustment of the height or angle of the platform 3 is more readily accomplished by the simultaneous adjustment of the V-springs 24 internal to both outer legs 8, 9 of the changing station 1. Further shown in FIG. 3 is a side view of the manner in which the right inner leg 7 is supported on the undersurface 3(*b*) of the changing station 1 by its bracket 20 and axle 23.

As described earlier, in FIG. 1 the vertical frame 2 manifests a left bracket 16 and right bracket 17, both of which are affixed to the rear surface 2(*b*) [not shown] of the frame 2. In one embodiment, the left U-bracket 16 is attached to the rear of the frame 2 by means of metal rivets 14 and the right U-bracket 17 is also attached to the rear of the frame by metal rivets 15. Imbedded magnets 12, 13, on the left and right sides of the platform inner surface 3(*a*) are positioned so as to make contact with the respective metal rivets 14, 15, thereby securing the platform 3 against the frame 2 for transporting or storage. Other means of securing the platform 3 against the frame 2 may be utilized, including, but not limited to, snaps, hook-and-felt mechanisms, zippers, groove/track connectors, and other fasteners. In some embodiments of the diaper changing stand 1, a handle 18 may be attached to the edge of the frame 2 for convenience in carrying.

In the disposition shown in FIG. 1, the changing station 1 is supported by the U-brackets 16, 17 on the backrest 5 of a sofa or similar seating accommodation, while the support bar 4 rests upon the seat cushion 36 of the sofa.

The rear surface 2(*b*) [not shown] of the frame 2 further comprises a recessed compartment 19 for the storage of various items that may be necessary or desirable during the process of diaper changing. In the embodiment shown, the compartment 19 features a left mesh net 30, a center mesh net 31, and a right mesh net 32. The three mesh nets 30, 31, 32 provide convenient and comfortable retention of items that may be stored within the compartment 19.

The horizontal position of the platform 3, shown in FIG. 1, is suitable for placement of an infant on the platform 3 upper surface 3(*a*). The changing station 1 in FIG. 1 further features two straps 33, 34 which, in the preferred embodiment, comprise a hook-and-felt fastening system, having a hook component strap 33 and a felt component strap 34. When an infant is placed upon the platform 3 upper surface, the hook component strap 33 and the felt component strap 34 may be placed around the mid-section of the child and pressed together to guard against the infant tumbling off the upper surface of the changing platform 3.

Figure 4:
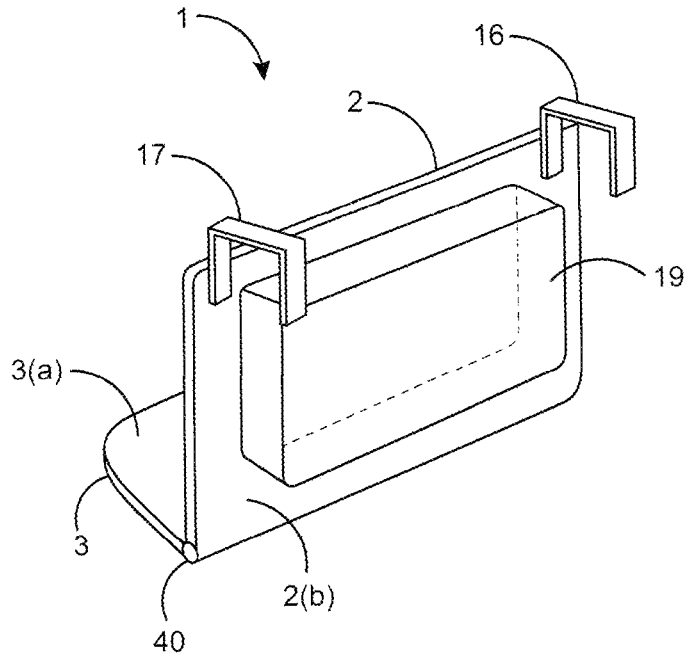
FIG. 4 presents a view of the rear of the diaper changing station, further showing two support brackets 16, 17 attached to the rear surface of the frame of the device.

FIG. 4 depicts a rear view of the diaper changing station 1 deployed for use, further showing a portion of the platform inner surface 3(*a*), the frame 2, frame rear surface 2(*b*), the backside of the recessed compartment 19, one end of the barrel pin 40, and both left and right U-brackets 16, 17.

The platform 3 and the frame 2 of the diaper changing station 1 are rotatably connected to each other by a hinging mechanism. The hinging mechanism may be a barrel hinge, piano hinge, lengthwise geared pin, or other similar hinging apparatus. This mechanism may be imbedded within the structure of either the platform 3 or the frame 2.

Figure 8:
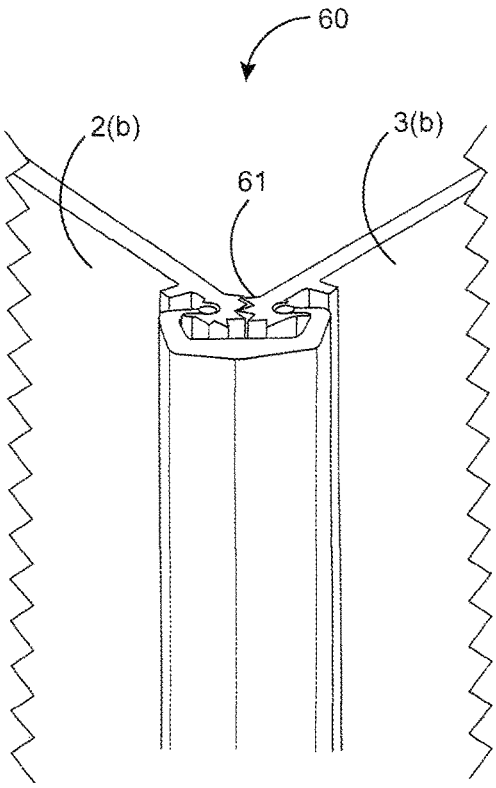
FIG. 8 illustrates a geared pin which may be utilized as the hinged mechanism providing a rotating connection between the frame 2 and platform 3.
Figure 9:
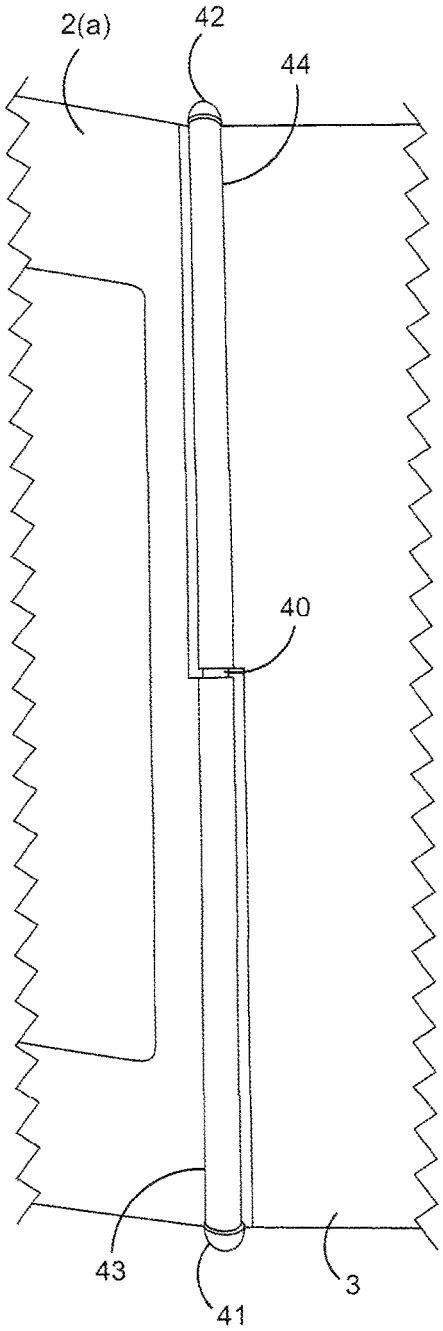
FIG. 9 illustrates a continuous barrel pin 40 which may be utilized as the hinged mechanism to provide a rotating connection between the frame 2 and platform 3.

FIG. 8 illustrates an alternative hinging mechanism, being a segmented view of a lengthwise geared pin 60, further having limit gears 61 which define the arc limits of rotation of the platform 3 relative to the frame 2. In another embodiment, a two-part barrel pin 43, 44, which is connected by a common axle 40, and having end retainer caps 41, 42 is utilized as the hinging mechanism, This embodiment is shown in FIG. 9.

Figure 5:
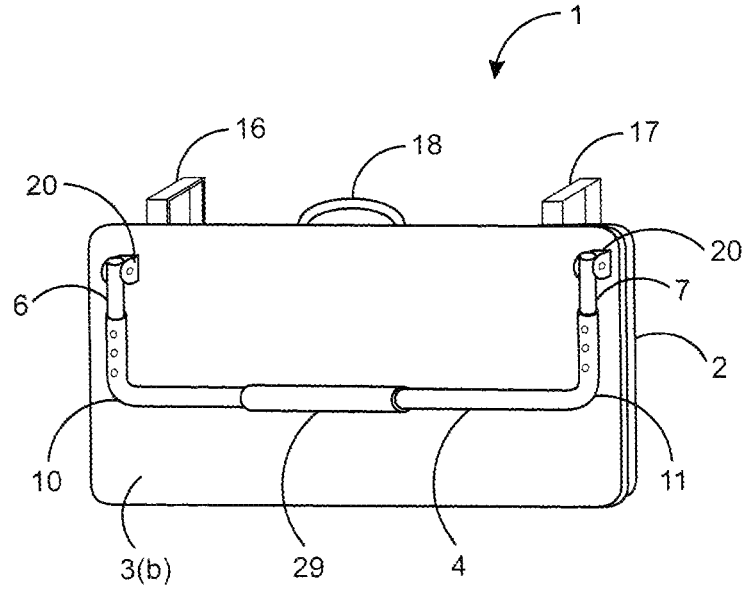
FIG. 5 depicts a view of the changing stand 1 in its compacted configuration, as viewed from the platform undersurface.

When diaper changing is finished, the changing station 1 may be placed into its compacted configuration for storing and/or transporting, as shown in FIG. 5. This is accomplished by rotating the support bar 4 rearward about the axles 23 of both brackets 20 until the support bar 4 abuts the platform 3 undersurface 3(*b*). The platform 3 is then rotated inward until the inner surface 3(*a*) of the platform 3 contacts the frame front surface 2(*a*). The diaper changing station 1 is shown in its compacted mode in FIG. 5.

The present inventive concept provides that the diaper changing station 1 may also be mounted on a door by at least one adjustable strap mounted at its first end to the upper edge of the frame 2 of the changing station 1 and attached at its second end to a remote U-bracket. The diaper changing station 1 is then capable of being positioned according to the height of the user, along a convenient length of a door surface. This is accomplished by adjusting the length of the strap(s) and the positioning of the remote U-bracket vertically so that the diaper changing station 1 is capable of being stabilized at various heights against the door surface.

While preferred embodiments of the present inventive concept have been shown and disclosed herein, it will be obvious to those persons skilled in the art that such embodiments are presented by way of example only, and not as a limitation to the scope of the inventive concept. Numerous variations, changes, and substitutions may occur or be suggested to those skilled in the art without departing from the intent, scope, and totality of this inventive concept. Such variations, changes, and substitutions may involve other features which are already known per se and which may be used instead of, in combination with, or in addition to features already disclosed herein. Accordingly, it is intended that this inventive concept be inclusive of such variations, changes, and substitutions, and by no means limited by the scope of the claims presented herein.

What is claimed is:

1. A portable diaper changing station, comprising:

a horizontally-oriented generally rectangular, planar platform having an inner surface and an undersurface, said platform manifesting a spaced-apart, support bar attached parallel to the undersurface, which support bar may be stored abutting the undersurface of said platform, or rotatingly deployed through a maximum ninety (90) degree arc into a fixed position orthogonal to the undersurface of said platform;

a vertically-oriented, compatibly-dimensioned frame having length and width dimensions compatible with the platform, said frame having a front surface and a rear surface, said frame further comprising a compartment recessed from the front surface for storage of various items and a pair of inverted U-brackets mounted on the rear surface of said frame;

a lengthwise hinge mechanism affixed through the common length dimension of both said planar platform and said frame, thereby rotatably connecting said platform to said frame; whereby the vertical frame and platform have the capability of being hingedly rotated toward each other such that the frame and platform abut one another as one compacted unit.

2. A device as in claim 1, further comprising embedded magnetized segments and metal contacts in the inner surface of said platform and also in the front surface of said frame, whereby when the platform and frame are rotated toward each other, the device may be magnetically secured in a compacted configuration.

3. A device as in claim 1, further comprising a handle affixed to the top edge of said frame.

4. A device as in claim 1, further comprising a hook-and-felt fastening mechanism attached to the inner surface of said platform.

5. A device as in claim 1, further comprising at least one strap attachable at its first end to the upper edge of said frame, and attachable at its second end to at least one U-bracket.

6. A device as in claim 1, further comprising a "wrap around" padding consisting of a friction-enhanced material, encircling the mid-section of the support bar.

7. A portable diaper changing station, comprising:

a horizontally-oriented generally rectangular planar platform having an inner surface and an undersurface, said platform manifesting a spaced apart, rotatable support bar attached parallel to the undersurface, which support bar may be stored abutting the undersurface of said platform, or rotatingly deployed through a maximum arc of ninety (90) degrees into a fixed position orthogonal to the undersurface of said platform;

said support bar comprising a tube extending approximately the length of the platform undersurface, and each end of said tube being bent orthogonally to form parallel left and right elbows, each elbow encompassing the proximal end of a tubular left inner leg and a tubular right inner leg, respectively, said elbows and inner legs further comprising a plurality of co-axial holes at the common contact surfaces of said inner legs and elbows, each inner leg further having upper co-axial holes at their distal ends;

a left bracket and a right bracket, each bracket having a left support arm and a right support arm with a co-axial aperture through each support arm, which apertures accommodate an axle, said axle further being inserted through the upper co-axial holes of each respective left and right inner leg;

two V-springs, each comprising a left branch and a right branch, with each branch culminating in a rounded cylindrical pin, said pins comprising a diameter corresponding to the co-axial holes of said elbows, whereby said V-springs being inserted internally to said left inner leg and right inner leg, respectively, provide that said pins form a spring-loaded method of adjustment for extension or retraction of the inner legs within said elbows such that the support bar may be spaced apart from the undersurface of said platform;

a vertically-oriented, compatibly-dimensioned frame having length and width dimensions compatible with the platform, said frame having a front surface and a rear surface, said frame further comprising a compartment recessed from the front surface for storage of various items and a pair of inverted U-brackets mounted on the rear surface of said frame;

a barrel pin mechanism affixed at the common junction of said platform and frame, thereby rotatably connecting said platform and frame to each other, whereby the vertical frame and platform are hingedly rotatable toward each other and further, may be secured as one compacted unit, by means fasteners mutually connected to the frame and platform.

8. A device as in claim 7, further comprising embedded magnetized segments and metal contacts in the inner surface of said platform and also in the front surface of said frame, whereby when the platform and frame are rotated toward each other, the device may be magnetically secured in a compacted configuration.

9. A device as in claim 7, further comprising a handle affixed to the top edge of said frame.

10. A device as in claim 7, further comprising a hook-and-felt fastening mechanism attached to the inner surface of said platform.

11. A device as in claim 7, further comprising at least one strap attachable at its first end to the upper edge of said frame, and attachable at its second end to at least one U-bracket.

12. A device as in claim 7, further comprising a "wrap around" padding consisting of a friction-enhanced material, encircling the mid-section of the support bar.

* * * * *